US006032485A

United States Patent [19]

Steinberg

[11] Patent Number: 6,032,485

[45] Date of Patent: Mar. 7, 2000

[54] MODIFIABLE JEWELRY

[76] Inventor: Daniel R. Steinberg, P.O. Box 1530 1141 Liberty Bell Dr., Cherry Hill, N.J. 08003

[21] Appl. No.: 09/037,346

[22] Filed: Mar. 10, 1998

[51] Int. Cl.[7] ..... A44C 9/00

[52] U.S. Cl. ..... 63/15; 63/15.7

[58] Field of Search ..... 63/1.14, 15, 15.1, 63/15.2, 15.3, 15.4, 15.45, 15.5, 15.6, 15.65, 15.7, 15.8

[56] References Cited

U.S. PATENT DOCUMENTS

| | | | |
|---|---|---|---|
| 221,728 | 11/1879 | Halsey | 63/15.4 |
| 581,549 | 4/1897 | Goetz | 63/15.4 X |
| 1,333,284 | 3/1920 | Schreiber | 63/15.4 |
| 1,586,606 | 6/1926 | Cain | 63/15.4 X |
| 1,885,930 | 11/1932 | Lowy | 63/15.8 |
| 2,182,876 | 12/1939 | Moldenhauer | 63/15 |
| 2,223,657 | 12/1940 | Baden | 63/1.14 |
| 2,453,955 | 11/1948 | Younghusband | 63/15 |
| 5,069,045 | 12/1991 | Mejias | 63/3 |
| 5,566,557 | 10/1996 | Pasquetti | 63/15.2 |

FOREIGN PATENT DOCUMENTS

| | | | |
|---|---|---|---|
| 18558 | 12/1913 | France | 63/15 |
| 2693880 | 1/1994 | France | 63/15 |
| 264083 | 4/1929 | Italy | 63/15 |
| 985078 | 3/1965 | United Kingdom . | |

*Primary Examiner*—Terry Lee Melius
*Assistant Examiner*—Andrea Chop
*Attorney, Agent, or Firm*—Stuart M. Goldstein

[57] ABSTRACT

A piece of jewelry, like a ring, bracelet, or necklace containing a center opening, consists of a main body section which takes the shape of the piece. This section has a channel extending around its side walls into which arms from covers are inserted. The covers overlay the main body section and slidably move over the main body section by means of the arms in the channels. In the preferred embodiment, two covers are provided on the main body section, although one or more than two covers are contemplated. The two covers slidably move in opposite directions on the main body section. The covers may have decorative ornamentation on their outer surfaces. When they are placed together and locked into position by a spring detent, the jewelry has one appearance. When the covers are together, they also conceal and protect the gem, inscription, or other decorative ornamentation on the top surface of the main body section. When the covers are moved apart, they expose the decorative ornamentation on the top surface of the piece of jewelry, presenting the piece with another appearance.

19 Claims, 3 Drawing Sheets

MODIFIABLE JEWELRY

BACKGROUND OF THE INVENTION

The present invention relates to jewelry, and particularly to rings, bracelets, and necklaces, which can be easily modified for esthetic purposes and which provides for the protection of mounted gems or other valuable decoration on the jewelry.

Pieces of jewelry which provide for the protection of valuable gems or other components of the piece are well know. Examples of these can be seen in U.S. Pat. No. 1,885,930, in which a ring is fully covered to protect the ring from harm and Great Britain Pat. Spec. 985,078, showing a moveable bracelet watch covering. Other jewelry may be altered for appearance purposes using removable components, as in U.S. Pat. No. 5,069,045 and U.S. Pat. No. 5,566,557. Still other jewelry, for example U.S. Pat. No. 2,223,657, has moveable parts designed to allow for hidden compartments. However, these prior jewelry constructions fail to provide for easy and reliable transformation of rings, bracelets, and the like from one use mode to another, to rapidly modify shape, function, and appearance.

SUMMARY OF THE INVENTION

It is the object of the present invention to overcome the limitations and disadvantages of existing modifiable jewelry.

It is another object of the invention to provide jewelry whose appearance is easily, reliably, and quickly transformed.

It is a further object of the invention to provide jewelry that is easily, reliably, and quickly modifiable for purposes of protecting valuable gems or covering up personal inscriptions.

It is still another object of the invention to provide jewelry which can easily, reliably, and quickly be modified to present different esthetic appearances in a single piece.

The present invention comprises a piece of jewelry containing a center opening, like a ring, bracelet, or necklace. It is contemplated that the jewelry can be of any polygon configuration, but it most commonly will be annular. The jewelry consists of a main body section which takes the shape of the piece. This section has a channel extending around its side walls into which arms from covers are inserted. The covers overlay the main body section and slidably move over the main body section by means of the arms in the channels. In the preferred embodiment, two covers are provided on the main body section, although one or more than two covers are contemplated. The two covers slidably move in opposite directions on the main body section. The covers may have decorative ornamentation on their outer surfaces. When they are placed together and locked into position by a spring detent, the jewelry has one appearance. When the covers are together, they also conceal and protect the gem, inscription, or other decorative ornamentation on the top surface of the main body section. When the covers are moved apart, they expose the decorative ornamentation on the top surface of the piece of jewelry, presenting the piece with another appearance.

The novel features which are considered as characteristic of the invention are set forth in particular in the appended claims. However, both as to their design, construction, and use, together with additional features and advantages thereof, they are best understood upon review of the following detailed description with reference to the accompanying drawings.

DETAILED DESCRIPTION OF THE INVENTION

Figure 1:
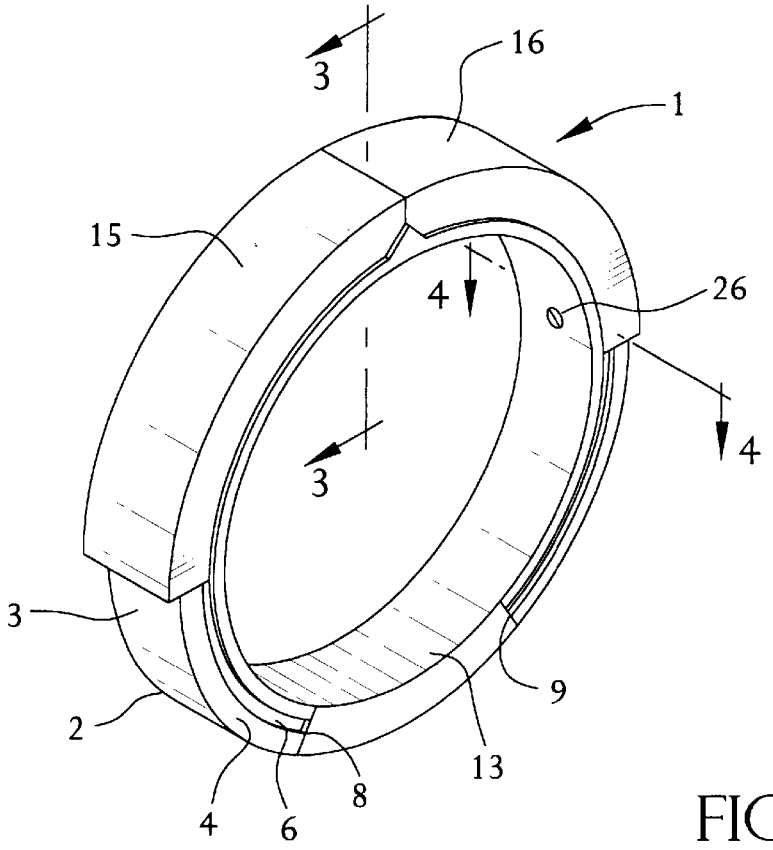
FIG. 1 is an isometric view of the ring embodiment of the invention with the covers in a closed position.
Figure 2:
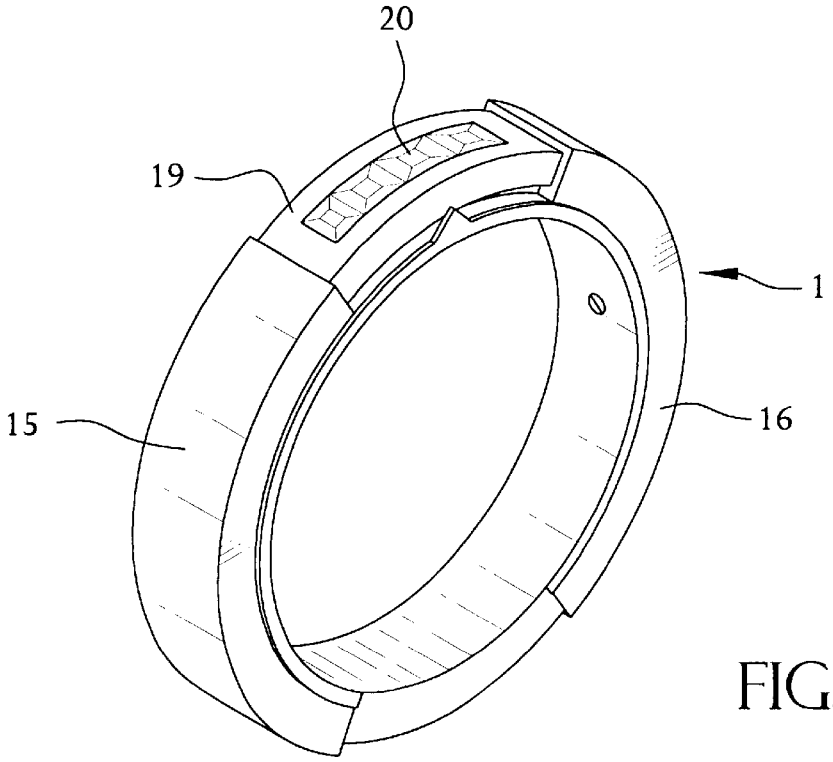
FIG. 2 is an isometric view of the ring embodiment of the invention with covers in an open position.

An annular finger ring 1 is shown in FIGS. 1 and 2. However, the description presented herein as it applies to the ring, pertains in like fashion and application to bracelets and necklaces, any jewelry which is configured with a center opening and an outer surface.

Figure 3:
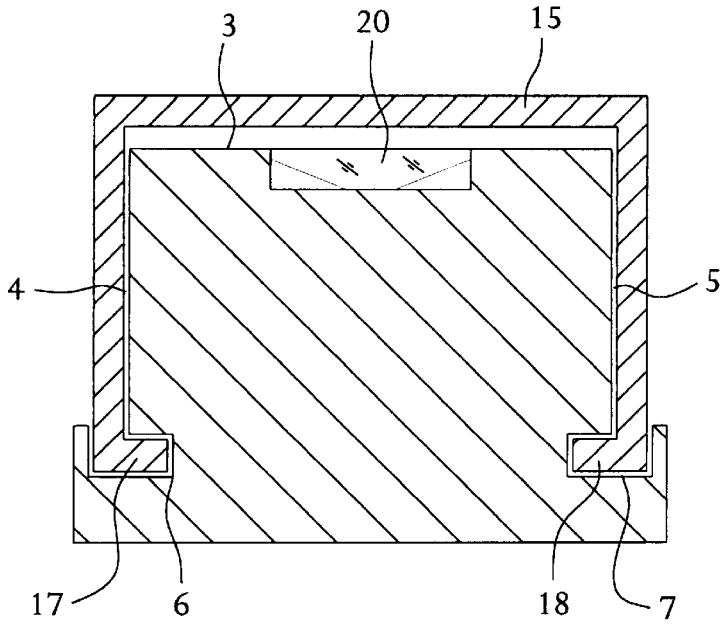
FIG. 3 is a sectional view taken at Line 3—3 of FIG. 1.

Ring 1 comprises a main or primary body portion 2. Body portion 2 has a top outer surface 3 and side surfaces 4 and 5. Inner surface 13 defines the opening through ring 1. Side surface 4 contains channel 6 and side surface 5 contains channel 7, illustrated in FIGS. 1 and 3. Channels 6 and 7 do not extend completely around each of the side surfaces of ring 1 in the embodiment of FIGS. 1 and 2. Each channel terminates at designated points, for instance at 8 and 9 of side 4 of body portion 2. In an alternate embodiment, shown in FIGS. 6 and 7, channel 10 and a corresponding channel on the opposite side of body 11 of ring 14, extend completely around both side surfaces 12 and the corresponding side surface on the opposite side of ring 14.

Covers 15 and 16, shown in FIGS. 1 and 2, are positioned over top outer surface 3 of ring 1. Cover 15 has two inwardly extending guide arms 17 and 18 which are inserted in channels 6 and 7 respectively. Arms 17 and 18 allow cover 15 to slideably travel along and over top surface 3 of body 2. Similarly, it can be appreciated that cover 16 has two arms identical to those of cover 15, which are also inserted into channels 6 and 7, allowing cover 16 to likewise travel along and over top surface 3 of body 2. Covers 15 and 16 are designed such that they can be positioned and held together, as shown in FIG. 1, and can be slid in opposite directions away from each other, as shown in FIG. 2.

When covers 15 and 16 are in position slid away from each other, shown in FIG. 2, an exposed area 19 on top surface 3 of main body portion 2 is revealed. It is on this exposed area 19 that diamonds, gems, or other decorative ornamentation 20 can be located.

When covers 15 and 16 are in position adjacent to each other, as shown in FIG. 1, the exposed area is covered and the decorative ornamentation on top surface 3 is hidden and protected.

The ring contemplated by the invention can have covers 15 and 16 which remain with a plain outer surface for simple fashion or to conceal valuable decorative ornamentation on area 19, as shown in FIGS. 1 and 2. The ring can also have covers 22 and 23 with decorative ornamentation 24 and 25, such that when the covers are in position together, as shown in FIG. 6 ring 14 is transformed and takes on a completely different appearance.

Figure 4:
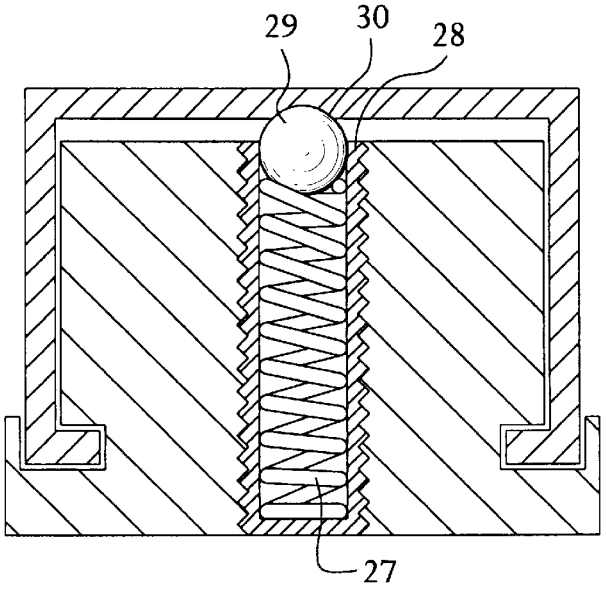
FIG. 4 is a sectional view taken at Line 4—4 of FIG. 2.
Figure 5:
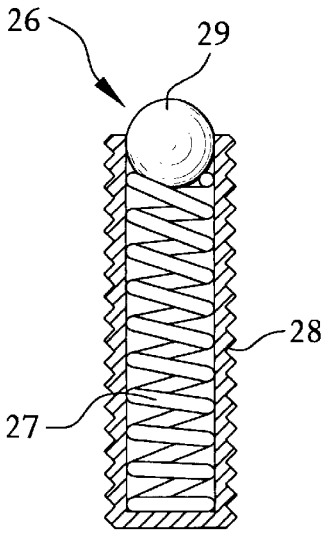
FIG. 5 is a side section view of the spring detent.

Covers 15 and 16 are secured in the position shown in FIG. 1 by means of a spring detent 26 which locks the covers when they are slid together. The placement of one such spring detent is seen in FIG. 1 for cover 16. A second spring detent for cover 15, unseen in FIG. 1, is also located through inner surface 13, immediately across from detent 26. As seen in FIGS. 4 and 5, spring detent 26 comprises spring 27 mounted in screw housing 28. Metallic ball 29 is carried by spring 27.

When covers 15 and 16 are together, as shown in FIG. 1, spring 27 urges ball 29 into recess 30, located, for example within cover 15. It can be appreciated that the second spring detent similarly acts to maintain cover 16 in position. When covers 15 and 16 are slid apart, their respective spring detents are released. For instance, for each cover 15, ball 29 is forced out of recess 30. The covers then travel along channels 6 and 7 to termination points 8 and 9. The balls 29 of the respective spring detents are then urged into a set second set of recesses in covers 15 and 16, to lock the covers in the position shown in FIG. 2. To replace covers 15 and 16 to their closed position shown in FIG. 1, the covers are simply pushed together, where spring detents 26 again lock them in place.

Figure 6:
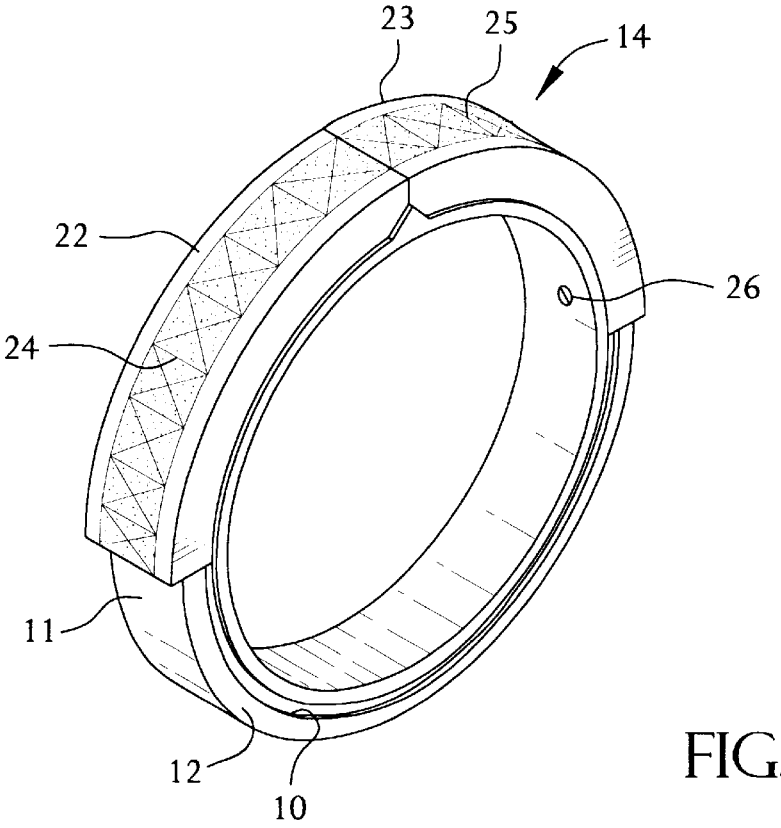
FIG. 6 is an isometric view of an alternative embodiment of the invention with the covers in a closed position.
Figure 7:
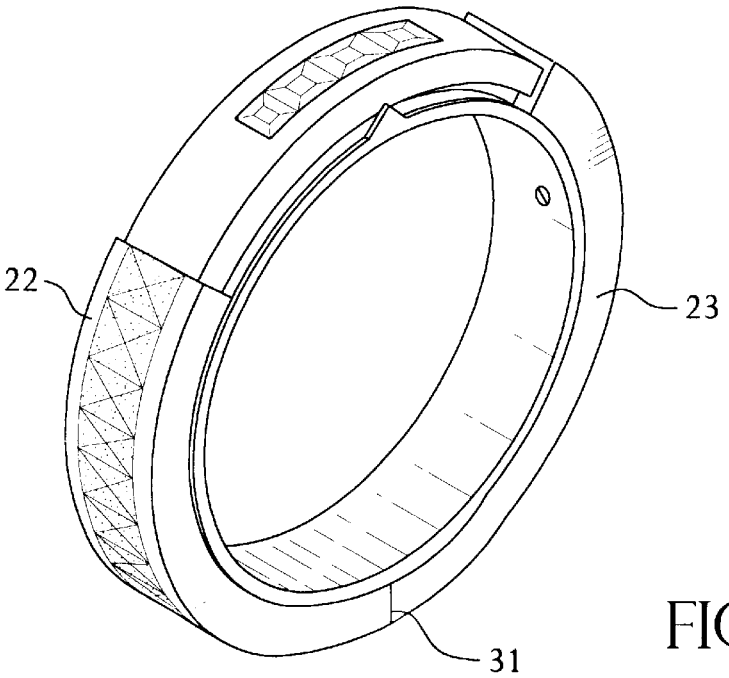
FIG. 7 is an isometric view of the alternative embodiment of the invention with the covers in an open position.

FIGS. 6 and 7 also show an alternative embodiment of the channel configuration. The channels upon which covers 22 and 23 travel, shown as channel 10, extend completely around side surface 12 and, as easily appreciated, the corresponding side surface on the other side of the ring. In this manner, covers 22 and 23 terminate when they meet, at point 31. The spring detent previously described, also locks the covers in position in this embodiment.

While the mechanics of this invention are shown with an annular finger ring, the invention is equally applicable for use with a bracelet or necklace. The jewelry need not be circular in shape; but is readily adaptable for most polygon shapes, as long as a sliding surface is available.

Certain novel features and components of this invention are disclosed in detail in order to make the invention clear in at least one form thereof. However, it is to be clearly understood that the invention as disclosed is not necessarily limited to the exact form and details as disclosed, since it is apparent that various modifications and changes may be made without departing from the spirit of the invention.

What is claimed:

1. A piece of jewelry comprising:

(a) an integral one piece, substantially annular primary body portion with an opening to allow the insertion of a finger, said body portion being sized to fully encircle the finger and comprising a top surface and adjacent side surfaces, said side surfaces smoothly and without separation extending substantially around the body portion, substantially defining the shape of the opening;

(b) channels formed within the body portion, said channels being inset from the side surfaces and extending substantially around the entire length of the side surfaces;

(c) cover means moveably mounted on the primary body portion, the cover means comprising guide means which protrude into and are fully encompassed within the channels and which slideably travel within the channels, whereby movement of the guide means within the channels moves the cover means over the primary body portion, exposing a section of the top surface when the cover means is moved in one direction over the primary body portion and concealing the section of the top surface when the cover means is moved in the opposite direction over the primary body portion.

2. A piece of jewelry as in claim 1 in which the guide means are arms extending from the cover means.

3. A piece of jewelry as in claim 2 in which the cover means comprises two separable cover sections.

4. A piece of jewelry as in claim 3 in which the two separable cover sections slide apart in opposite directions to expose the top surface of the primary body portion and slide together in opposite directions to conceal the top surface of the primary body portion.

5. A piece of jewelry as in claim 1 in which the cover means comprises two separable cover sections.

6. A piece of jewelry as in claim 5 in which the two separable cover sections slide apart in opposite directions to expose the top surface of the primary body portion and slide together in opposite directions to conceal the top surface of the primary body portion.

7. A piece of jewelry as in claim 5 in which each of said cover sections comprise outer surfaces for the placement of decorative ornamentation.

8. A piece of jewelry as in claim 7 in which said exposed section of the top surface of the primary body portion has decorative ornamentation.

9. A piece of jewelry as in claim 8 whereby movement of the cover means over the primary body portion exposes both the exposed section of the top surface and the decorative ornamentation when the cover means is moved in one direction over the primary body portion and conceals said exposed section of the top surface and the decorative ornamentation when the cover means is moved in the opposite direction over the primary body portion.

10. A piece of jewelry as in claim 1 in which said cover means comprises an outer surface for the placement of decorative ornamentation.

11. A piece of jewelry as in claim 10 in which the exposed section of the top surface comprises decorative ornamentation.

12. A piece of jewelry as in claim 11 whereby movement of the cover means over the primary body portion exposes both the exposed section of the top surface and the decorative ornamentation when the cover means is moved in one direction over the primary body portion and conceals said exposed section of the top surface and the decorative ornamentation when the cover means is moved in the opposite direction over the primary body portion.

13. A piece of jewelry as in claim 1 in which the exposed section of the top surface comprise decorative ornamentation.

14. A piece of jewelry as in claim 9 in which said cover means comprises an outer surface for the placement of decorative ornamentation.

15. A piece of jewelry as in claim 14 whereby movement of the cover means over the primary body portion exposes both the exposed section of the top surface and the decorative ornamentation when the cover means is moved in one direction over the primary body portion and conceals said exposed section of the top surface and the decorative ornamentation when the cover means is moved in the opposite direction over the primary body portion.

16. A piece of jewelry as in claim 9 in which the cover means comprises two separable cover sections.

17. A piece of jewelry as in claim 16 in which said cover sections comprise outer surfaces for the placement of decorative ornamentation.

18. A piece of jewelry as in claim 17 whereby movement of the cover sections over the primary body portion exposes both the exposed section of the top surface and the decorative ornamentation when the cover sections are moved away from each other over the primary body portion and conceals said exposed section of the top surface and the decorative ornamentation when the cover sections are moved towards each other over the primary body portion.

19. A piece of jewelry as in claim 1 which comprises a spring bias detent which limits the movement of the cover means over the primary body portion.

* * * * *